US010843479B2

(12) United States Patent
Takahashi et al.

(10) Patent No.: US 10,843,479 B2
(45) Date of Patent: Nov. 24, 2020

(54) LIQUID SUPPLY APPARATUS, LIQUID DISCHARGE APPARATUS, AND LIQUID SUPPLY METHOD

(71) Applicant: CANON KABUSHIKI KAISHA, Tokyo (JP)

(72) Inventors: Atsushi Takahashi, Tama (JP); Yoshinori Nakagawa, Kawasaki (JP); Takatoshi Nakano, Yokohama (JP); Takuya Fukasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/573,967

(22) Filed: Sep. 17, 2019

(65) Prior Publication Data

US 2020/0108622 A1 Apr. 9, 2020

(30) Foreign Application Priority Data

Oct. 5, 2018 (JP) ..... 2018-189673

(51) Int. Cl.
*B41J 2/175* (2006.01)

(52) U.S. Cl.
CPC ..... *B41J 2/17566* (2013.01); *B41J 2/17596* (2013.01)

(58) Field of Classification Search
CPC ... B41J 2/17566; B41J 2/17596; B41J 29/393
See application file for complete search history.

(56) References Cited

U.S. PATENT DOCUMENTS 9,272,522 B1 3/2016 Kosaka et al. ..... B41J 2/17566
9,597,888 B2 3/2017 Takahashi et al. .. B41J 2/17566
9,682,564 B2 6/2017 Saeki et al. ..... B41J 2/17513
10,357,977 B2 7/2019 Mukoyama et al. ..... B41J 2/17596
10,427,412 B2 10/2019 Okude et al. ..... B41J 2/17523
2010/0231621 A1 9/2010 Watanabe et al. ..... 347/7
2019/0009562 A1 1/2019 Abe et al. ..... B41J 2/175
2019/0009563 A1 1/2019 Tokisawa et al. ..... B41J 2/175
2019/0283443 A1 9/2019 Mukoyama et al. ..... B41J 2/16517
2019/0299648 A1 10/2019 Tokisawa et al. ... B41J 2/17596
2019/0299649 A1 10/2019 Shimoyama et al. ... B41J 29/13
(Continued)

FOREIGN PATENT DOCUMENTS

JP 2010-208151 9/2010

OTHER PUBLICATIONS

U.S. Appl. No. 16/575,057, filed Sep. 18, 2019.

*Primary Examiner* — Lamson D Nguyen
(74) *Attorney, Agent, or Firm* — Venable LLP

(57) ABSTRACT

A liquid supply apparatus comprises: a liquid supply unit to perform an operation to supply liquid from a main tank to a sub tank; a liquid surface detection unit configured to detect a liquid surface of the liquid stored in the sub tank; and a control unit configured to control the liquid supply unit to execute first liquid supply operation to control the liquid supply unit to supply liquid to the sub tank until the liquid surface is detected by the liquid surface detection unit and a second liquid supply operation to supply liquid to the sub tank after the liquid surface is detected by the liquid surface detection unit. The control unit controls, based on at least one of a liquid supply amount and a liquid supply time in the first liquid supply operation, the time during which the second liquid supply operation is executed.

10 Claims, 15 Drawing Sheets

(56) References Cited

U.S. PATENT DOCUMENTS

| | | | | |
|---|---|---|---|---|
| 2019/0299650 | A1 | 10/2019 | Saeki et al. | B41J 2/17566 |
| 2020/0108626 | A1* | 4/2020 | Fukasawa | B41J 29/02 |
| 2020/0108627 | A1* | 4/2020 | Nakano | B41J 2/185 |
| 2020/0108629 | A1* | 4/2020 | Nakano | B41J 2/175 |

* cited by examiner

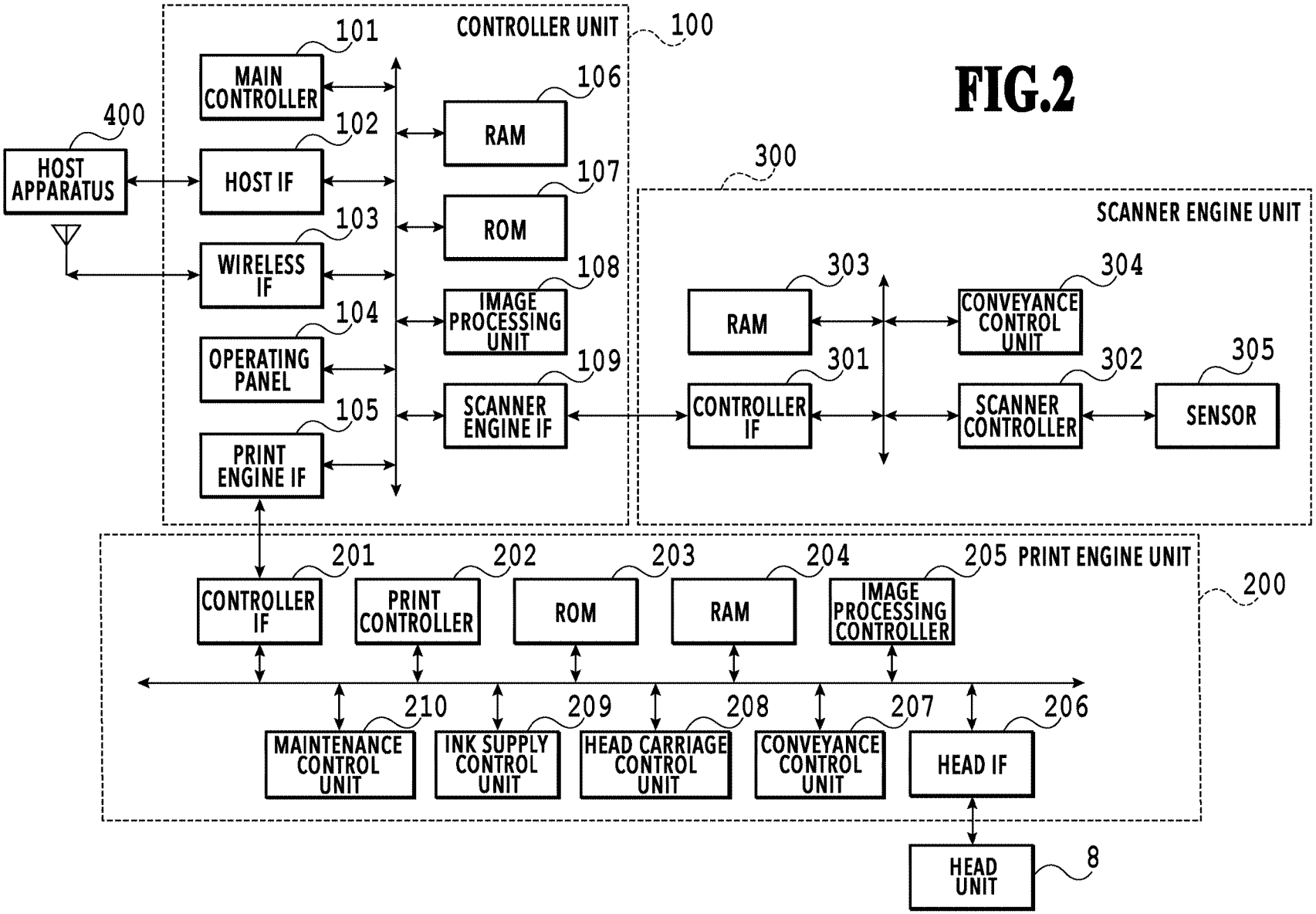
FIG.2
CONTROLLER UNIT
100
101
MAIN CONTROLLER
102
HOST IF
103
WIRELESS IF
104
OPERATING PANEL
105
PRINT ENGINE IF
106
RAM
107
ROM
108
IMAGE PROCESSING UNIT
109
SCANNER ENGINE IF
400
HOST APPARATUS
SCANNER ENGINE UNIT
300
301
CONTROLLER IF
302
SCANNER CONTROLLER
303
RAM
304
CONVEYANCE CONTROL UNIT
305
SENSOR
200
PRINT ENGINE UNIT
201
CONTROLLER IF
202
PRINT CONTROLLER
203
ROM
204
RAM
205
IMAGE PROCESSING CONTROLLER
206
HEAD IF
207
CONVEYANCE CONTROL UNIT
208
HEAD CARRIAGE CONTROL UNIT
209
INK SUPPLY CONTROL UNIT
210
MAINTENANCE CONTROL UNIT
8
HEAD UNIT

INITIAL FILLING INK SUPPLY (FIRST)

INITIAL FILLING INK SUPPLY (FOURTH)

| INK SUPPLY IN THE INITIAL FILLING SEQUENCE | SUPPLY DURATION TIME (CONVENTIONAL) | SUPPLY DURATION TIME (THE PRESENT INVENTION) |
|---|---|---|
| FIRST: SUPPLY AMOUNT HIGH/HIGH | +4sec | +10sec |
| SECOND: SUPPLY AMOUNT HIGH | +4sec | +10sec |
| THIRD: SUPPLY AMOUNT MEDIUM | +4sec | +7sec |
| FOURTH: SUPPLY AMOUNT LOW | +4sec | +4sec |

FIG.13

| MAIN TANK SIZE | BUBBLE/INK RATIO | SUPPLY DURATION TIME (CONVENTIONAL) | SUPPLY DURATION TIME (THE PRESENT INVENTION) |
|---|---|---|---|
| LARGE SIZE | LOW | +4sec | +4sec |
| MEDIUM SIZE | MEDIUM | +4sec | +7sec |
| SMALL SIZE | HIGH | +4sec | +10sec |

FIG.15

LIQUID SUPPLY APPARATUS, LIQUID DISCHARGE APPARATUS, AND LIQUID SUPPLY METHOD

BACKGROUND OF THE INVENTION

Field of the Invention

The present invention a liquid supply apparatus for supplying liquid from a main tank to a sub tank, a liquid discharge apparatus including this, and a liquid supply method.

Description of the Related Art

Japanese Patent Laid-Open No. 2010-208151 discloses a printing apparatus that supplies ink stored in a main tank to a sub tank functioning as a storage unit to allow the ink stored in the sub tank to be discharged through a printing head to thereby performing a printing operation. The sub tank includes a liquid surface detection unit to detect the liquid surface of the ink supplied to the interior of the sub tank. After the liquid surface of the ink in the sub tank is detected by the liquid surface detection unit, ink is further supplied from the main tank to the sub tank for a fixed time.

In the case of the above method of supplying ink from the main tank to the sub tank, there may be a case where bubbles in the main tank are mixed with ink to enter the sub tank, which causes foamed ink in the sub tank. In this case, the liquid detection unit detects the liquid surface including bubbles prior to the supply of a target ink amount to the sub tank. This consequently cause, if the ink supply operation is stopped based on this detection result, an insufficient amount of ink to be supplied to the sub tank.

According to Japanese Patent Laid-Open No. 2010-208151, a fixed amount of ink is supplied by performing, even after the detection of the liquid surface by the liquid surface detection unit, a fixed number of ink supply operations (or ink supply operations for a fixed time). This may compensate an insufficient amount of ink supplied to the sub tank even when an erroneous detection is caused by bubbles contaminating the sub tank.

However, depending on the ink supply conditions, various changes are caused in the amount of bubbles from the main tank to the sub tank (or in a volume occupied by the bubbles). For example, the amount of bubbles contaminating the sub tank has a correlation with the ink supply amount according to which an increase of the ink supply amount causes an increase of bubbles contaminating the sub tank, which causes a proportional increase of errors in the detection of the ink amount, resulting in an insufficient amount ink supplied to the sub tank. This may prevent, depending on the amount of bubbles contaminating the interior of the sub tank, an appropriate amount of ink from being supplied, even when a fixed amount of ink is supplied after the liquid surface is detected by the liquid surface detection unit as in Patent Literature 1.

SUMMARY OF THE INVENTION

The present invention provides a liquid supply apparatus, comprising: a main tank for storing liquid; a sub tank for storing liquid supplied from the main tank; a liquid supply unit configured to perform an operation to supply liquid from the main tank to the sub tank; a liquid surface detection unit for detecting a liquid surface of the liquid stored in the sub tank; and a control unit configured to control the liquid supply unit to execute a first liquid supply operation to control the liquid supply unit to supply liquid to the sub tank until the liquid surface is detected by the liquid surface detection unit and a second liquid supply operation to supply liquid to the sub tank after the liquid surface is detected by the liquid surface detection unit. The control unit controls, based on at least one of a liquid supply amount and a liquid supply time in the first liquid supply operation, the time during which the second liquid supply operation is executed.

The present invention provides a liquid discharge apparatus, comprising: a sub tank for storing liquid supplied from a main tank; and a liquid ejection head through which liquid supplied from the sub tank is discharged. The liquid discharge apparatus includes: a liquid supply unit for performing an operation to supply liquid from the main tank to the sub tank; a liquid surface detection unit for detecting a liquid surface of the liquid stored in the sub tank; and a control unit configured to control the liquid supply unit to execute a first liquid supply operation to control the liquid supply unit to supply liquid to the sub tank until the liquid surface is detected by the liquid surface detection unit and a second liquid supply operation to supply liquid to the sub tank after the liquid surface is detected by the liquid surface detection unit. The control unit controls, based on at least one of a liquid supply amount and a liquid supply time in the first liquid supply operation, the time during which the second liquid supply operation is executed.

According to the present invention, an appropriate amount of liquid can be supplied to the storage unit for storing liquid.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIG. 13 illustrates the relation between the ink supply amount and a supply duration time;

FIG. 15 illustrates the relation between the size of the main tank and the supply duration time.

DESCRIPTION OF THE EMBODIMENTS

The following section will describe in detail an embodiment of a liquid discharge apparatus according to the present invention with reference to the drawings. The following description will be made based by way of an example of an ink jet printing apparatus as a liquid discharge apparatus (hereinafter also may be simply referred to as "printing apparatus"). The term "ink" should be widely interpreted like the definition of the above term "printing". Thus, the term "ink" means such liquid that may be used, by being applied on a printing medium, for the formation of an image, a design, or a pattern for example or the machining of the printing medium or the processing of ink (e.g., the solidification or insolubilization of the coloring material in ink applied to the printing medium).

First Embodiment

Figure 1:
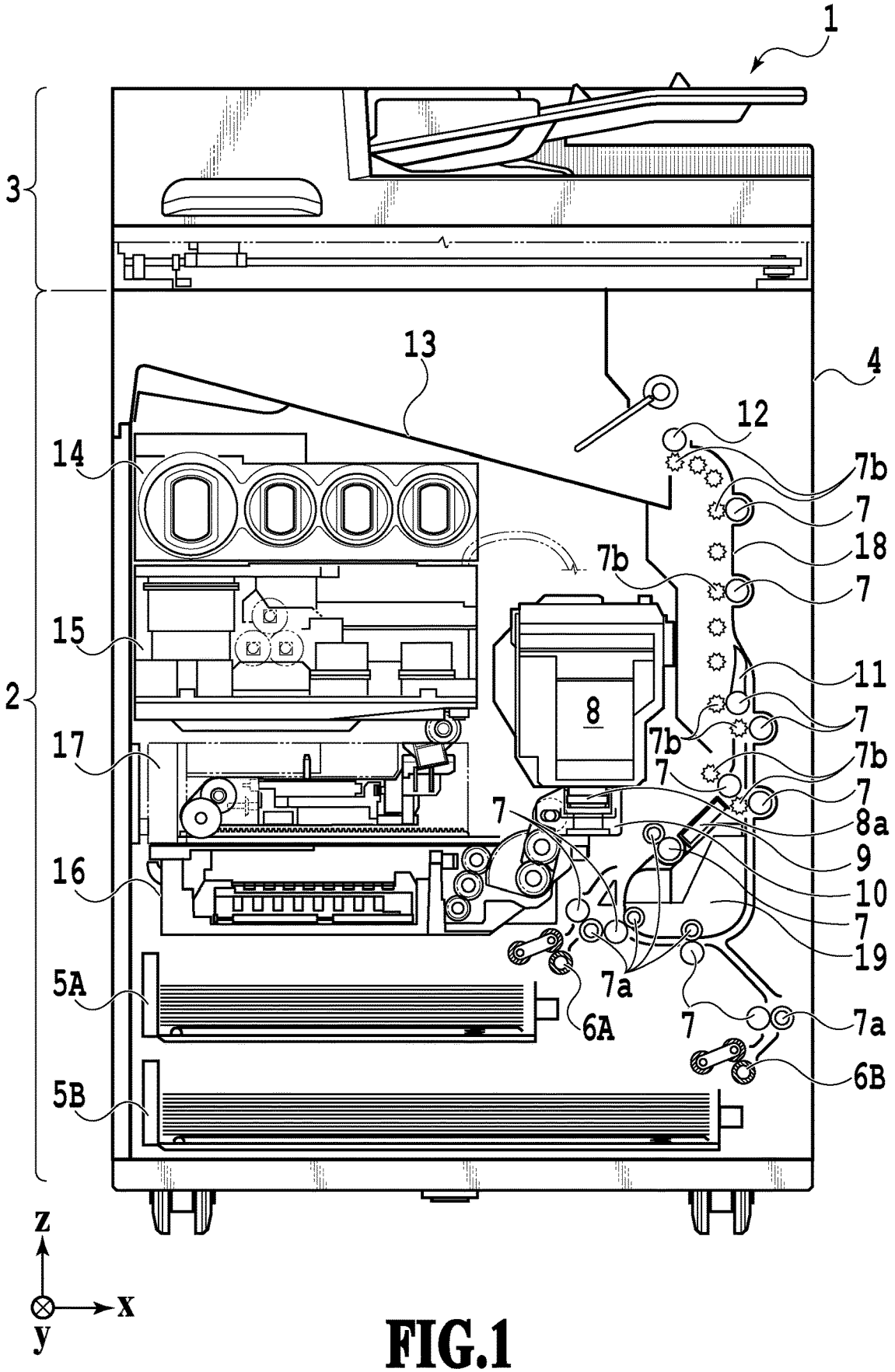
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
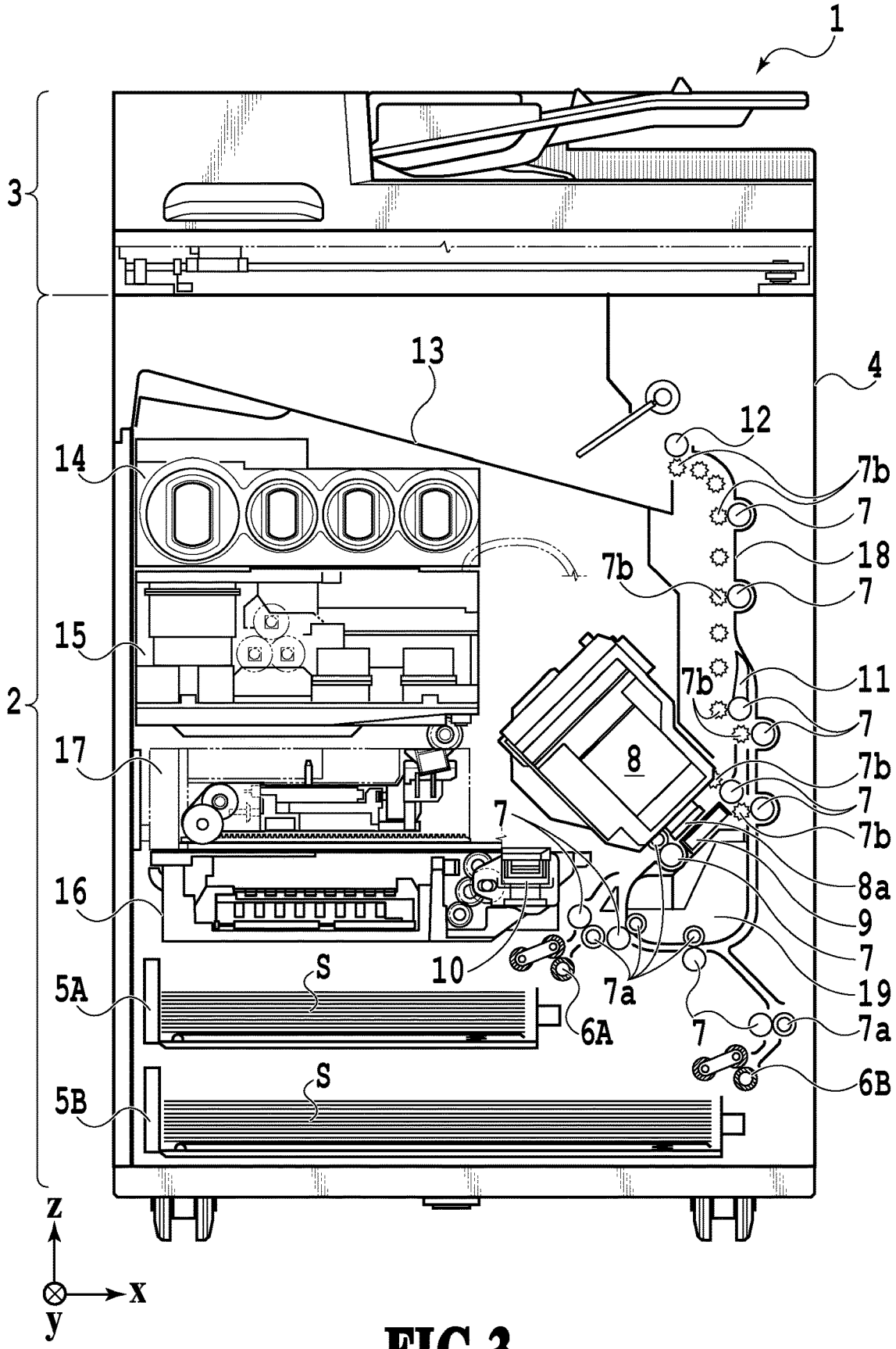
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 4:
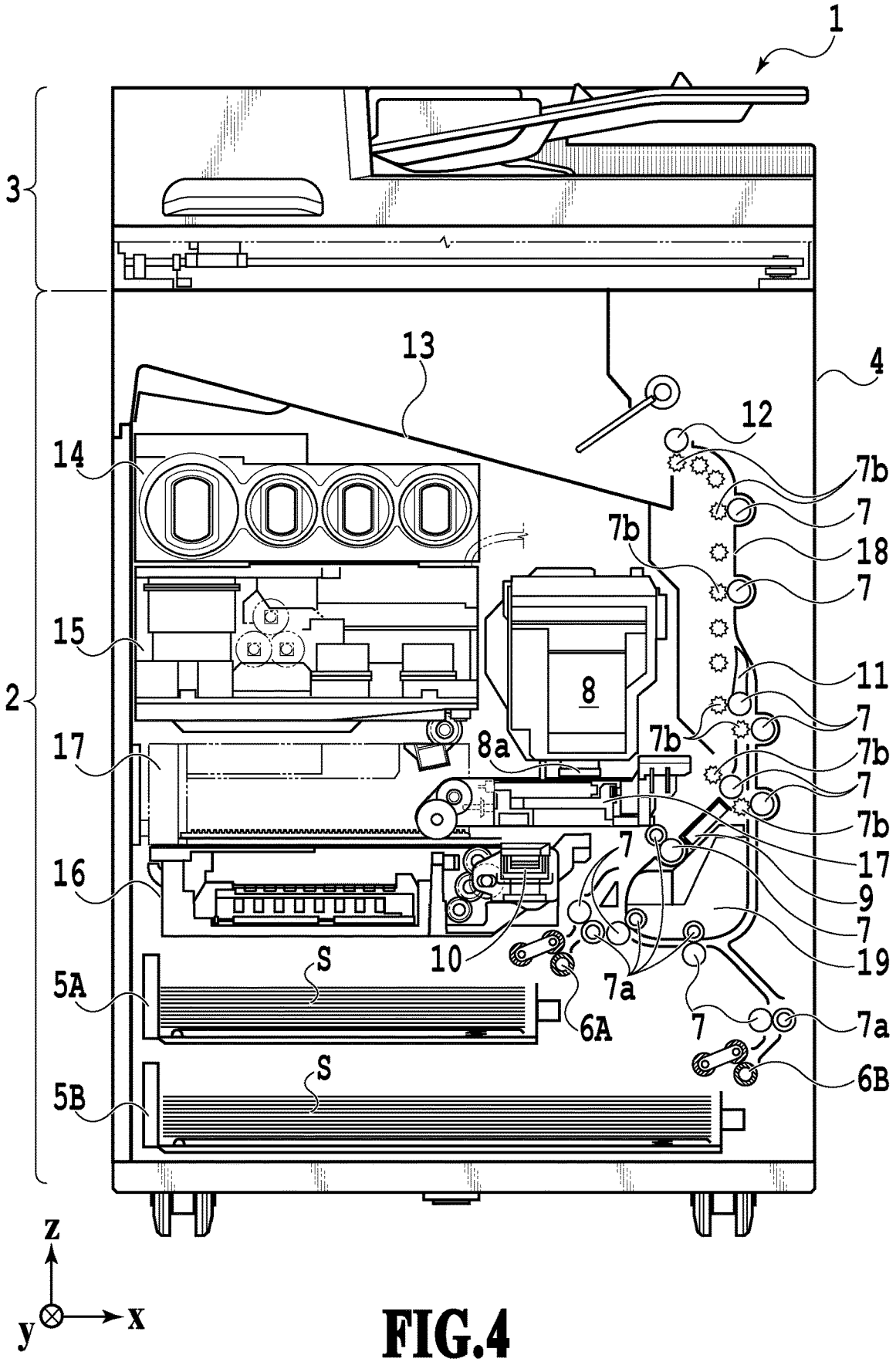
FIG. 4 illustrates the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

(Ink Supply Unit)

Figure 5:
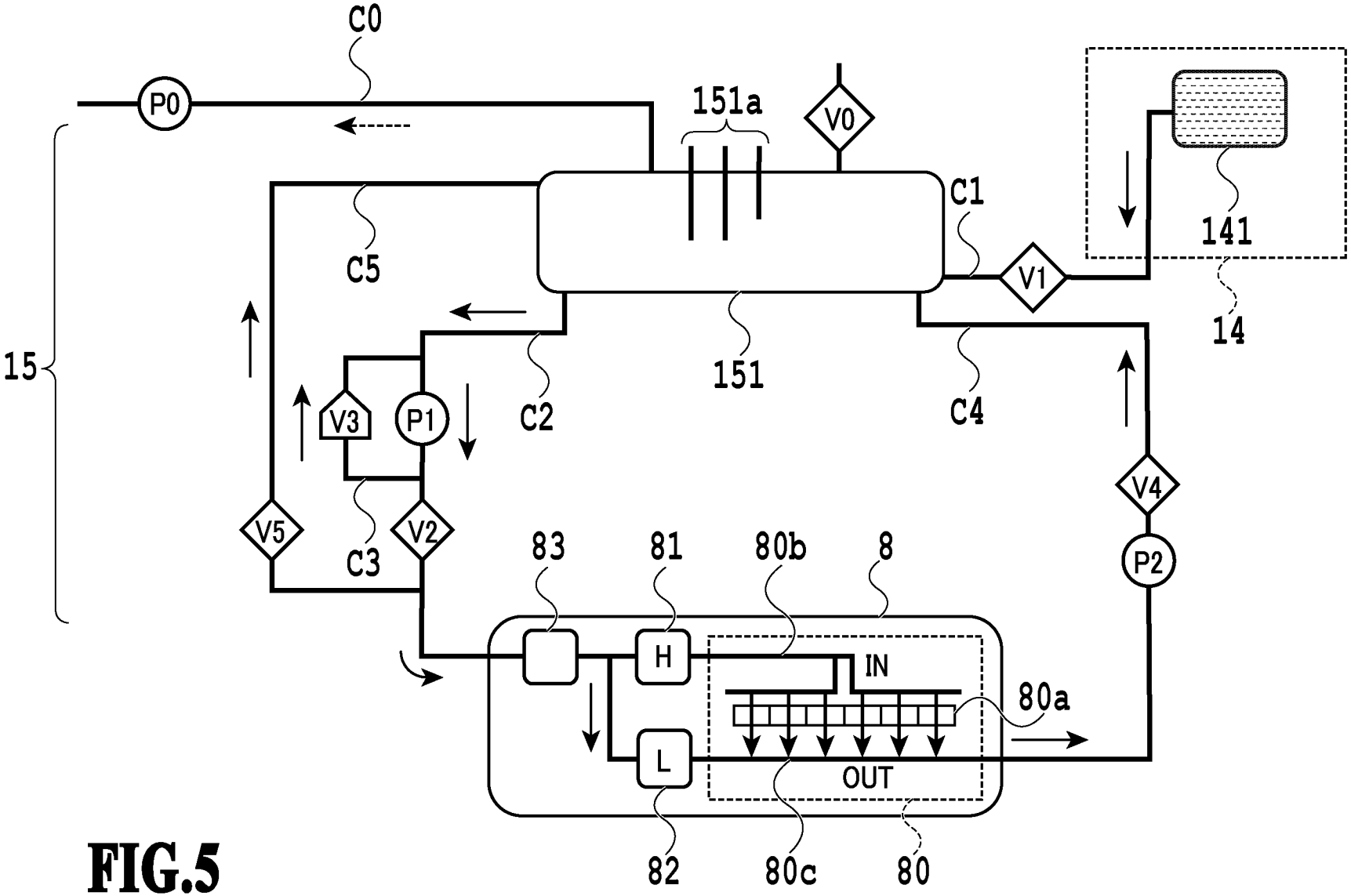
FIG. 5 illustrates the configuration of a flow path of an ink circulation system.

FIG. 5 illustrates an ink supply unit 15 used in the ink jet printing apparatus 1 of this embodiment. The ink supply unit 15 is configured to supply ink from the ink tank unit 14 to the printing head 8. Although the configuration in which ink of one color is used is shown, a plurality of such configurations are actually used for the respective inks. The ink supply unit 15 are basically controlled by the ink supply control unit 209 shown in FIG. 2. The following the configurations of the respective units.

Ink is mainly circulated between a sub tank 151 and the printing head 8. The printing head 8 performs an ink discharge operation based on image data. Ink not discharged is collected in the sub tank 151 again.

The sub tank 151 for storing ink of a predetermined amount is connected to a supply flow path C2 to supply ink to the printing head 8 and a collection flow path C4 to collect ink from the printing head 8. Specifically, the sub tank 151, the supply flow path C2, the printing head 8, and the collection flow path C4 constitute a circulation path in which ink is circulated.

The sub tank 151 has a liquid surface sensing unit 151*a* having a plurality of pins. In this embodiment, for the purpose of detecting the liquid surface, three electrode pins are provided (the first pin E1 (the first electrode), the second pin E2 (the second electrode), the third pin E3 (the third electrode)) in the sub tank 151 along a vertical direction. The distance between the bottom part of the sub tank 151 and the lower end of the first pin E1 in the vertical direction is shorter than the distance between the bottom part of the sub tank 151 and the lower end of the second pin E2 in the vertical direction. Thus, when ink is supplied into the sub tank 151, then the liquid surface of the ink firstly has a contact with the first pin E1 and then has a contact with the second pin E2 when ink of a predetermined amount is supplied. The distance between the third pin and the sub tank in the vertical direction is set to be equal to or shorter than the distance between the first pin E1 and the bottom part of the sub tank 151 in the vertical direction. Thus, in a state where at least the first pin E1 or the second pin E2 has a contact with the liquid surface, the third pin E3 is allowed to always have a contact with the liquid surface.

A predetermined voltage is applied between the first pin E1 and the third pin E3 and between the second pin E2 and the third pin E3, respectively. The first pin E1 and the second pin E2 touch ink to thereby become conductive with the third pin E3. Thus, this configuration can show, based on whether the respective pins are in a conductive state or a nonconductive state, the height of the ink liquid surface (i.e., the amount of ink remaining in the sub tank 151).

A depressurization pump P0 is a negative pressure generation source (negative pressure generation source) to depressurize the interior of the sub tank 151. An atmosphere opening valve V0 is a valve to switch whether or not the interior of the sub tank 151 is allowed to communicate with the atmosphere. The main tank 141 is a tank to store ink (ink) supplied to the sub tank 151. The main tank 141 is configured by a flexible member. A volume change of the flexible member is used to allow the sub tank 151 to be filled with ink. The main tank 141 is detachably attached to the body of the printing apparatus. The sub tank 151 is connected to the main tank 141 by a tank connection flow path C1 in the middle of which a tank supply valve V1 is provided opened or closed so as to switch the communication and blocking between the sub tank 151 and the main tank 141.

Under the above-described configuration, when the liquid surface sensing unit 151*a* detects that the amount of ink in the sub tank 151 is lower than a predetermined amount, then the ink supply control unit 209 closes the atmosphere opening valve V0, a supply valve V2, a collection valve V4, and a head exchange valve V5 and opens the tank supply valve V1. In this state, the ink supply control unit 209 allows the depressurization pump P0 to operate. Then, the interior of the sub tank 151 is allowed to have a negative pressure, thereby supplying ink from the main tank 141 to the sub tank 151. When the liquid surface sensing unit 151*a* allows the ink in the sub tank 151 to reach a predetermined amount, then the ink supply control unit 209 closes the tank supply valve V1 and stops the depressurization pump P0. This operation to supply ink to the sub tank is an operation performed when ink normally flows in the ink supply unit 15. The ink supply is blocked when an ink leakage detection processing (which will be described later) determines that an ink leakage is caused in the ink supply unit 15.

The supply flow path C2 is an ink flow path to supply ink from the sub tank 151 to the printing head 8 in the middle of which a supply pump P1 and the supply valve V2 are provided. During the printing operation, the supply pump P1 can be driven while the supply valve V2 being opened to thereby circulate ink in the circulation path while supplying ink to the printing head 8. The amount of ink consumed by the printing head 8 per a unit time varies depending on image data. The flow rate of the supply pump P1 is determined so as to cope with even a case where the printing head 8 performs a discharge operation requiring the maximum ink consumption amount per a unit time.

A relief flow path C3 is a flow path provided at the upstream side of the supply valve V2 to connect the upstream side and the downstream side of the supply pump P1 in the middle of which a relief valve V3 is provided that functions as a differential pressure valve. When the amount of ink supplied from the supply pump P1 per a unit time is higher than the total value obtained by adding the discharge amount of the printing head 8 per a unit time to the flow rate of the collection pump P2 per a unit time (ink suction amount), then the relief valve V3 is opened depending on a pressure acting thereon. This consequently forms a circulation flow path configured by a part of the supply flow path C2 and the relief flow path C3. By providing the relief flow path C3 having the above configuration, the amount of ink supplied to printing head 8 can be adjusted depending on the amount of ink consumed in the printing head 8, thus providing a stabilized fluid pressure within the circulation path regardless of image data.

The collection flow path C4 is a flow path to collect ink in the sub tank 151 from the printing head 8 in the middle of which a collection pump P2 and the collection valve V4 are provided. In order to circulate ink in the circulation path, the collection pump P2 functions as a negative pressure generation source to suck ink from the printing head 8. The collection pump P2 can be driven to thereby cause an appropriate pressure difference between an IN flow path 80*b* and an OUT flow path 80*c* of the printing head 8, thereby circulating ink between the IN flow path 80*b* and the OUT flow path 80*c*. The configuration of the flow path in the printing head 8 will be described in detail later.

The collection valve V4 is a valve that prevents an ink backward flow when no printing operation is performed (i.e., when no ink is circulated in the circulation path). The circulation path of this embodiment is configured so that the sub tank 151 is provided at the upper side of the printing head 8 in the vertical direction (see FIG. 1). This causes a risk where, when the supply pump P1 or the collection pump P2 is not driven, a water head difference between the sub tank 151 and the printing head 8 causes an undesirable backward flow of ink from the sub tank 151 to the printing head 8. In order to prevent such a backward flow, this embodiment provides the collection valve V4 in the collection flow path C4.

The supply valve V2 and the head exchange valve V5 also function as a valve to prevent the backward flow from the sub tank 151 to the printing head 8 when no printing operation is performed (i.e., when no ink is circulated in the circulation path).

A head exchange flow path C5 is a flow path that provides the mutual connection between the supply flow path C2 and the air space in the sub tank 151 (a space where no ink is stored) in the middle of which the head exchange valve V5 is provided. One end of the head exchange flow path C5 is connected to the upstream of the printing head 8 of the supply flow path C2 and the other end is connected to the upper part of the sub tank 151 to communicate with the internal air space. The head exchange flow path C5 is used to collect ink from the printing head 8 during use in order to exchange the printing head 8 or to transport the printing apparatus 1 for example. The head exchange valve V5 is controlled by the ink supply control unit 209 so that the head exchange valve V5 is closed except for a case where the printing apparatus 1 is initially filled with ink and a case where ink is collected from the printing head 8. The above-described supply valve V2 is provided between a connection unit of the supply flow path C2 and the head exchange flow path C5 and a connection unit of the relief flow path C3 and the supply flow path C2.

Next, the following section will describe the configuration of the flow path in the printing head 8. Ink supplied from the supply flow path C2 to the printing head 8 is allowed to pass through a filter 83. The resultant ink is subsequently supplied to the first negative pressure control unit 81 that generates a low negative pressure (a negative pressure having a high absolute pressure) and the second negative pressure control unit 82 that generates a high negative pressure (a negative pressure having a low absolute pressure). The pressures in the first negative pressure control unit 81 and the second negative pressure control unit 82 are generated within an appropriate range by the driving of the collection pump P2.

An ink discharge unit 80 has a plurality of printing element substrates 80*a* including therein a plurality of ejection ports to form a long ejection port array. Also provided along the direction along which the printing element substrates 80*a* are arranged are a common supply flow path 80*b* (IN flow path) to guide ink supplied from the first negative pressure control unit 81 and a common collection flow path 80*c* (OUT flow path) to guide ink supplied from the second negative pressure control unit 82. Each of the printing element substrates 80*a* has an individual supply flow path connected to the common supply flow path 80*b* and an individual collection flow path connected to the common collection flow path 80*c*. Thus, ink in each of the printing element substrates 80*a* is allowed to flow into the common supply flow path 80*b* having a relatively-low negative pressure to subsequently flow to the common collection flow path 80*c* having a relatively-high negative pressure. When an ejection operation is performed within the printing element substrates 80*a*, a part of ink moving from the common supply flow path 80*b* to the common collection flow path 80*c* is consumed by being ejected through the ejection port. The not-ejected ink moves to the collection flow path C4 via the common collection flow path 80*c*.

Figure 6A:
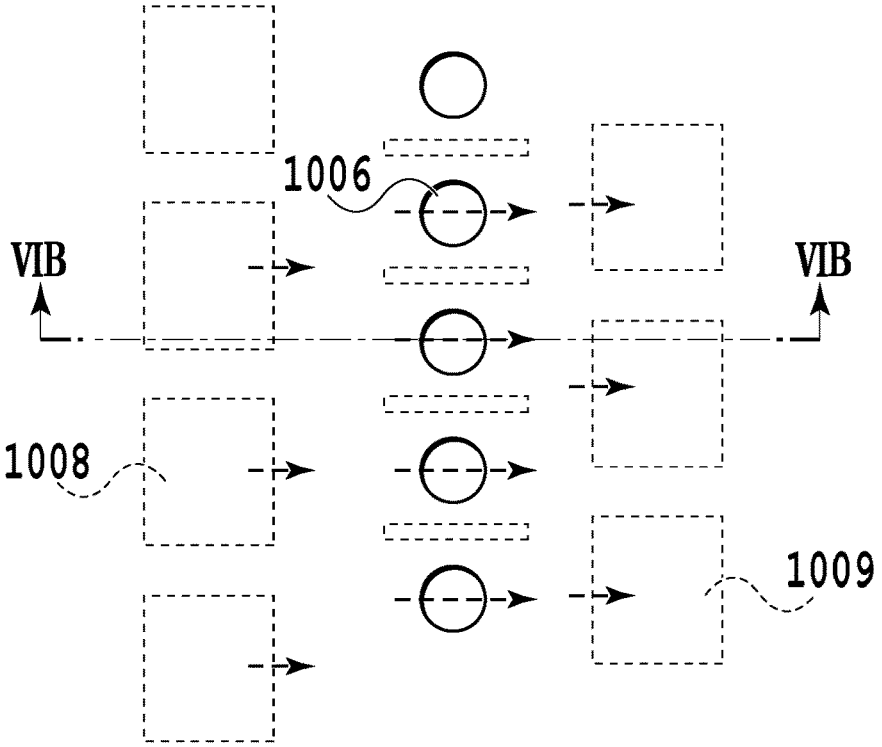
FIGS. 6A and 6B illustrate ejection port and a pressure chamber.
Figure 6B:
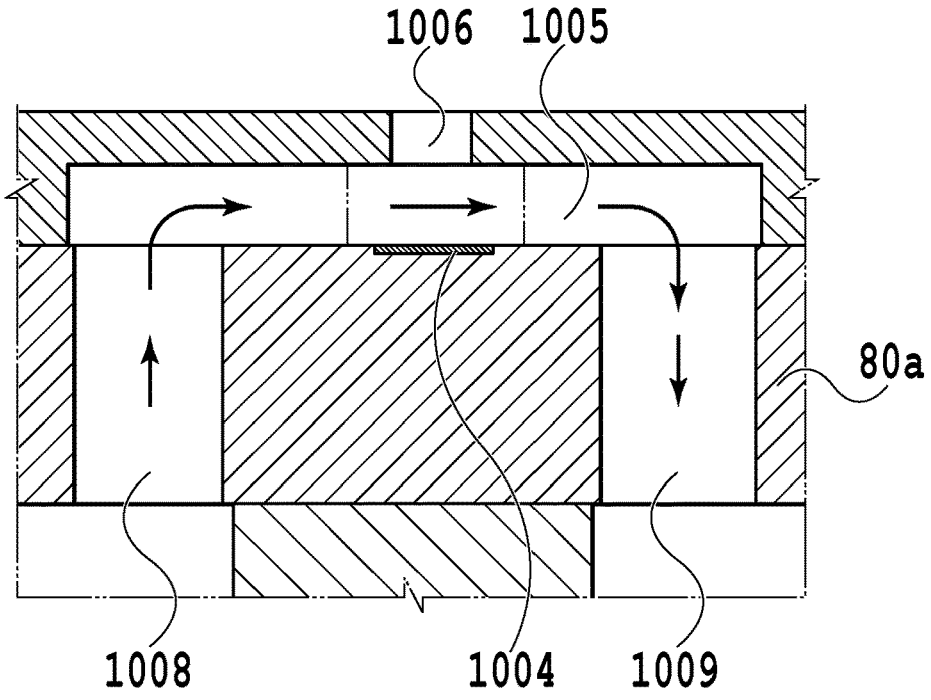

FIG. 6A is a schematic plan view illustrating a part of the printing element substrate 80*a*. FIG. 6B is a schematic cross-sectional view taken along the section line VIB-VIB in FIG. 6A. The printing element substrate 80*a* includes a pressure chamber 1005 to be filled with ink and ejection port 1006 for discharging ink. A position in the pressure chamber 1005 opposed to the ejection port 1006 is provided with printing element 1004. The printing element substrate 80*a* includes a plurality of individual supply flow paths 1008 connected to the common supply flow path 80*b* and a plurality of individual collection flow paths 1009 connected to the common collection flow path 80*c* to correspond to each ejection port 1006.

The above-described configuration allows the printing element substrate 80*a* to allow ink to flow into the common supply flow path 80*b* having a relatively-low negative pressure (a high pressure) to flow to the common collection flow path 80*c* having a relatively-high negative pressure (a low pressure). More particularly, ink flows in an order of: the common supply flow path 80*b*→the individual supply flow path 1008→the pressure chamber 1005→the individual collection flow path 1009→the common collection flow path 80*c*. When ink is ejected by the printing element 1004, a part of ink moving from the common supply flow path 80*b* to the common collection flow path 80*c* is discharge out of the printing head 8 by being discharged from the ejection port 1006. On the other hand, ink not ejected from the ejection port 1006 is collected in the collection flow path C4 via the common collection flow path 80*c*.

In order to perform a printing operation in the above-described configuration, the ink supply control unit 209 closes the tank supply valve V1 and the head exchange valve V5 and opens the atmosphere opening valve V0, the supply valve V2, and the collection valve V4 to drive the supply pump P1 and the collection pump P2. This consequently establishes a circulation path in an order of the sub tank 151→the supply flow path C2→printing head 8→the collection flow path C4→the sub tank 151. When the amount of ink supplied from the supply pump P1 per a unit time is higher than the total value of the amount of the discharge from the printing head 8 per a unit time and the flow rate of the collection pump P2 per a unit time, then ink is allowed to flow from the supply flow path C2 to the relief flow path C3. This consequently adjusts the flow rate of ink flowing from the supply flow path C2 to the printing head 8.

When no printing operation is performed, the ink supply control unit 209 stops the supply pump P1 and the collection pump P2 and closes the atmosphere opening valve V0, the supply valve V2, and the collection valve V4. This consequently stops the ink flow in the printing head 8 and suppresses a backward flow caused by a difference in the water head between the sub tank 151 and the printing head 8. By closing the atmosphere opening valve V0, the sub tank 151 can be suppressed from having an ink leakage or ink evaporation therefrom.

In order to collect ink from the printing head 8, the ink supply control unit 209 closes the tank supply valve V1, the supply valve V2, and the collection valve V4 and opens the atmosphere opening valve V0 and the head exchange valve V5 to drive the depressurization pump P0. This consequently causes the interior of the sub tank 151 to have a negative pressure state, thereby causing ink in the printing head 8 to be collected in the sub tank 151 via the head exchange flow path C5. As described above, the head exchange valve V5 is a valve that is closed during a normal printing operation or a standby state and that is opened when ink is collected from the printing head 8. However, the head exchange valve V5 is also opened when the head exchange flow path C5 is filled with ink during an initial filling of the printing head 8.

<Ink Filling>

The following section will describe how to allow the ink circulation system to be filled with ink described with reference to FIG. 5. The ink filling operation is performed, after the main tank 141 is attached to the ink tank unit 14 for example, so that the sub tank 151, the printing head 8, and a flow path through which ink is circulated are filled with ink. The ink filling operation is performed not only at the arrival of the printing apparatus 1 but also after the exchange of the printing head 8 or after the collection of ink from the printing head 8 to the sub tank 151 for a transportation purpose.

Figure 7:
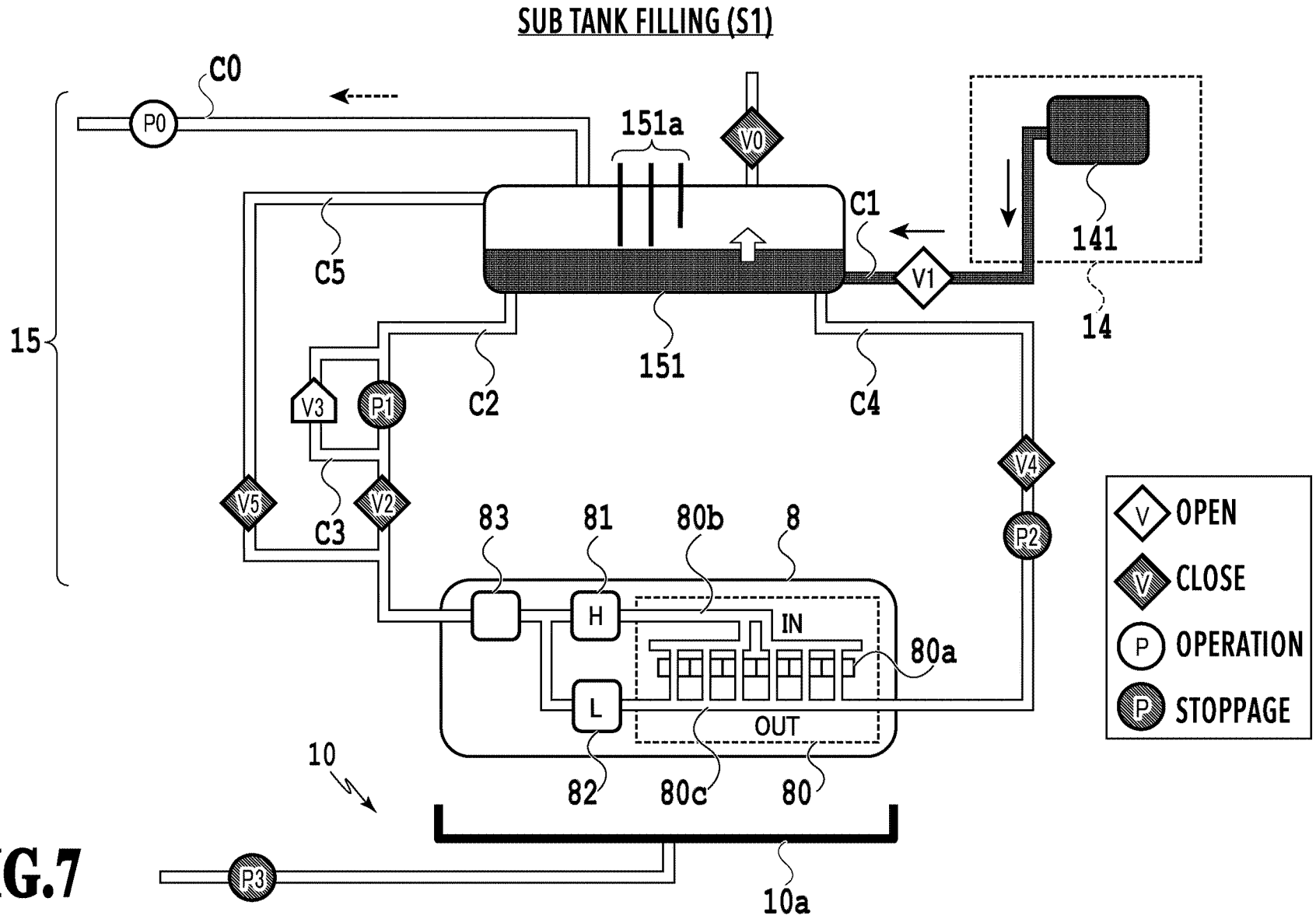
FIG. 7 illustrates a state in which a sub tank is filled with ink.

FIG. 7 illustrates the state of the ink circulation system when ink is supplied from the main tank 141 to the sub tank 151. In this state, the atmosphere opening valve V0, the supply valve V2, the head exchange valve V5, and the collection valve V4 are closed (CLOSE) and the tank supply valve V1 is opened (OPEN) and the supply pump P1 and the collection pump P2 are stopped. When the depressurization pump P0 is driven in this state, a negative pressure occurs in the sub tank 151, thereby supplying ink from the main tank 141 to the sub tank 151 via the tank connection flow path C1. When the sub tank 151 receives a predetermined amount of ink, then the ink supply control unit 209 closes the tank supply valve V1 and stops the depressurization pump P0. Thereafter, the ink supply control unit 209 opens the atmosphere opening valve V0 to expose the negative pressure in the sub tank 151 to the atmosphere.

Next, the ink supply control unit 209 supplies ink from the sub tank 151 to allow an upstream flow path to be filled with ink. The upstream flow path is a collective term meaning a flow path provided between the sub tank 151 and the printing head 8 and includes the supply flow path C2, the relief flow path C3, and the head exchange flow path C5.

Figure 8:
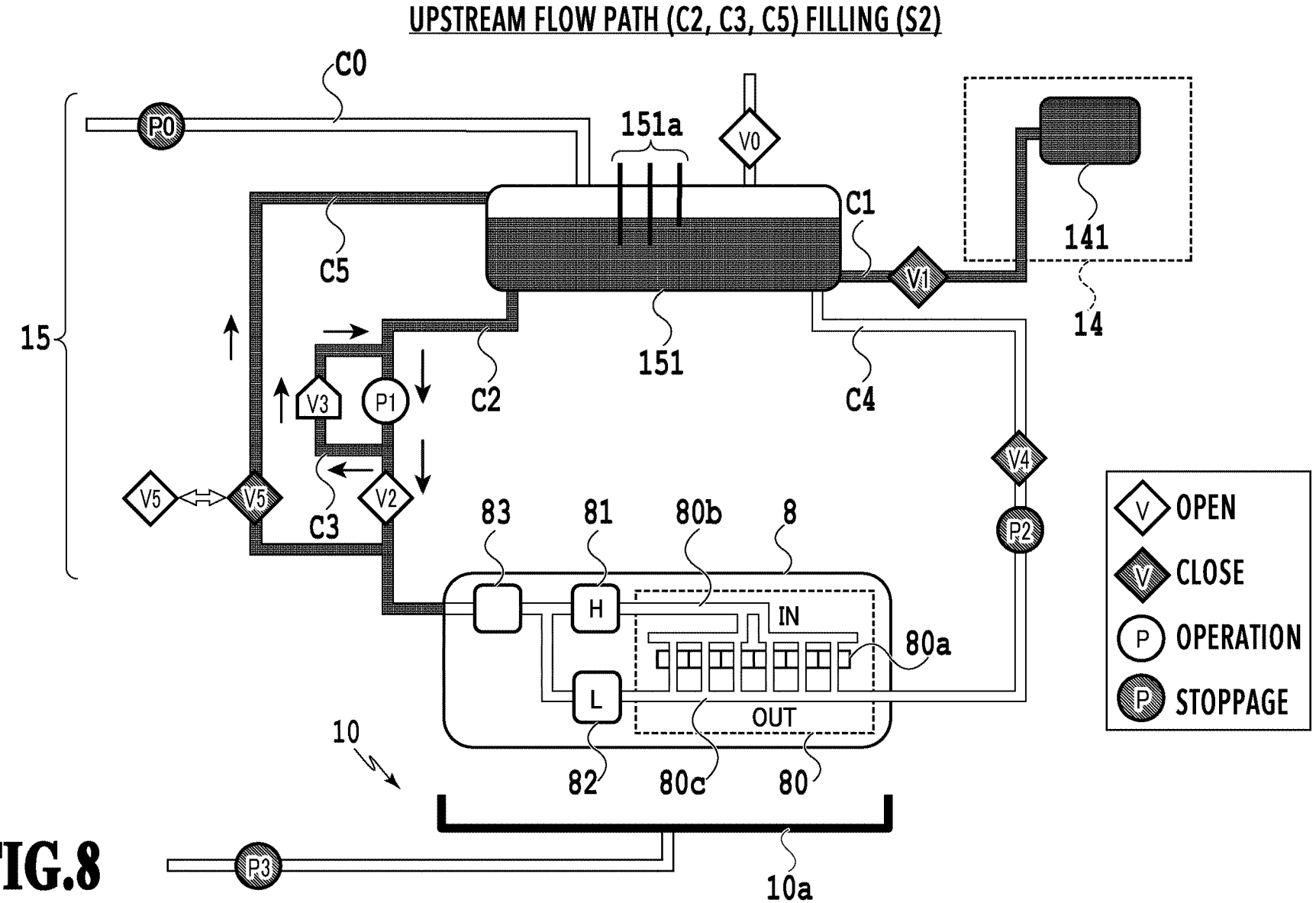
FIG. 8 illustrates a state in which an upstream flow path is filled with ink.

FIG. 8 illustrates the state of the ink circulation system when the upstream flow path is filled with ink. When the ink supply operation to the sub tank 151 is completed, the supply valve V2 and the head exchange valve V5 are opened. In this state, the supply pump P1 is driven to supply ink from the sub tank 151 to thereby allow the upstream flow path to be filled with ink. The collection pump P2 is stopped. No predetermined negative pressure is applied to the first negative pressure control unit 81 and the second negative pressure control unit 82 having a differential pressure valve configuration. Thus, the negative pressure control units 81 and 82 are both closed, thus preventing ink from flowing to the printing head 8. After the upstream flow path is filled with ink, then the ink supply control unit 209 allows the printing head 8 to be filled with ink.

Figure 9:
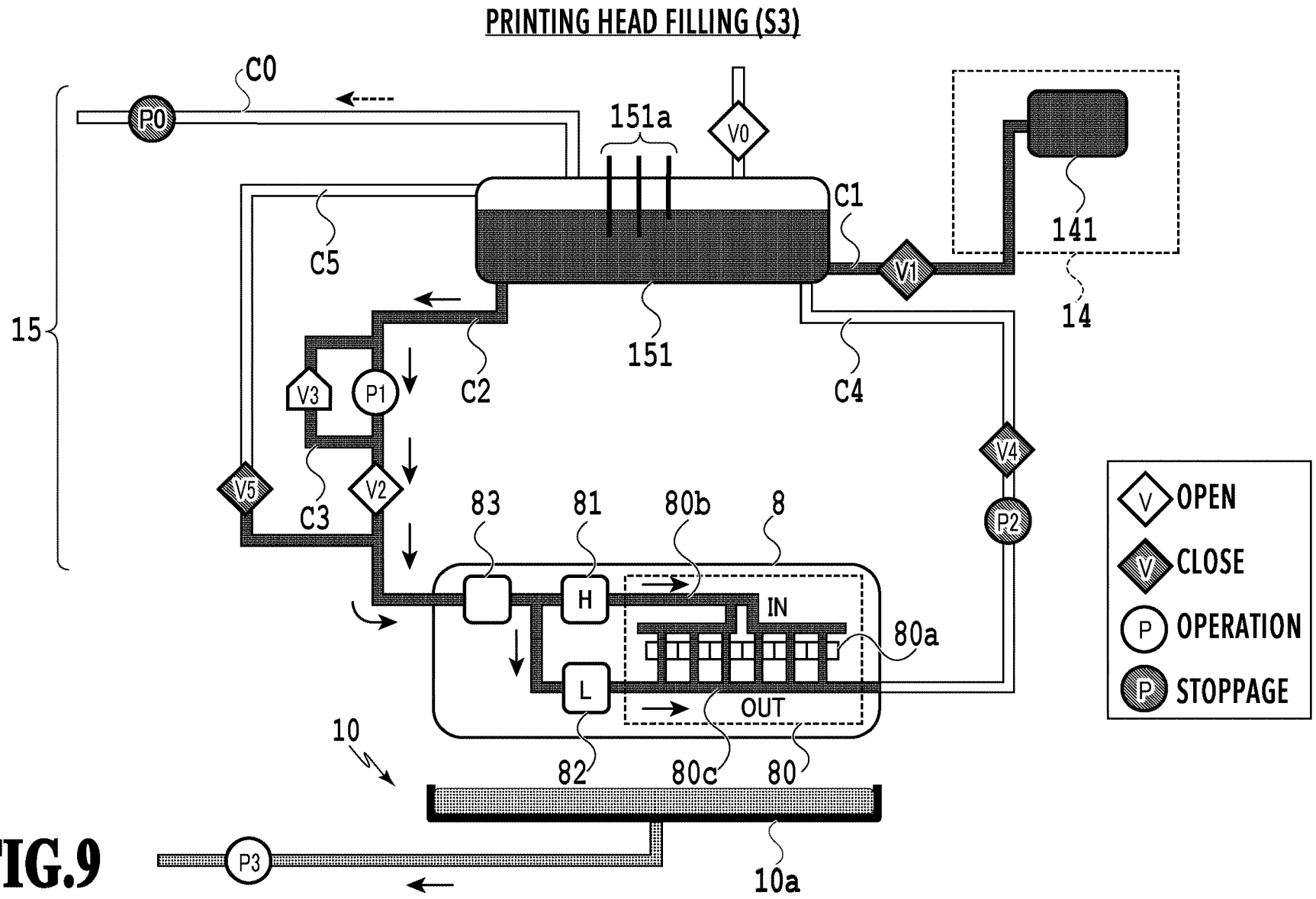
FIG. 9 illustrates a state in which a printing head is filled with ink.

FIG. 9 illustrates the state of the ink circulation system when the printing head is filled with ink. In the stage shown in FIG. 9, by a processing to allow the upstream flow path to be filled with ink, ink is supplied to a point up to the supply flow path C2 in front of the printing head 8. Then, the ink supply control unit 209 drives the cap unit 10 to cap the printing head 8. Specifically, the cap member 10*a* of the cap unit 10 covers the ejection port face 8*a* of the printing head 8. Next, the ink supply control unit 209 drives the depressurization pump P3 of the cap unit 10. Specifically, while sending ink by the supply pump P1, a negative pressure is generated in the cap unit 10. This negative pressure opens the negative pressure control unit in the printing head 8 to draw ink to the ejection port, thereby performing an ink filling operation. After a predetermined time has passed, the ink supply control unit 209 stops the supply pump P1 and the depressurization pump P3. After the completion of the ink filling operation to the printing head 8, the ink supply control unit 209 allows the collection flow path C4 to be filled with ink.

Figure 10:
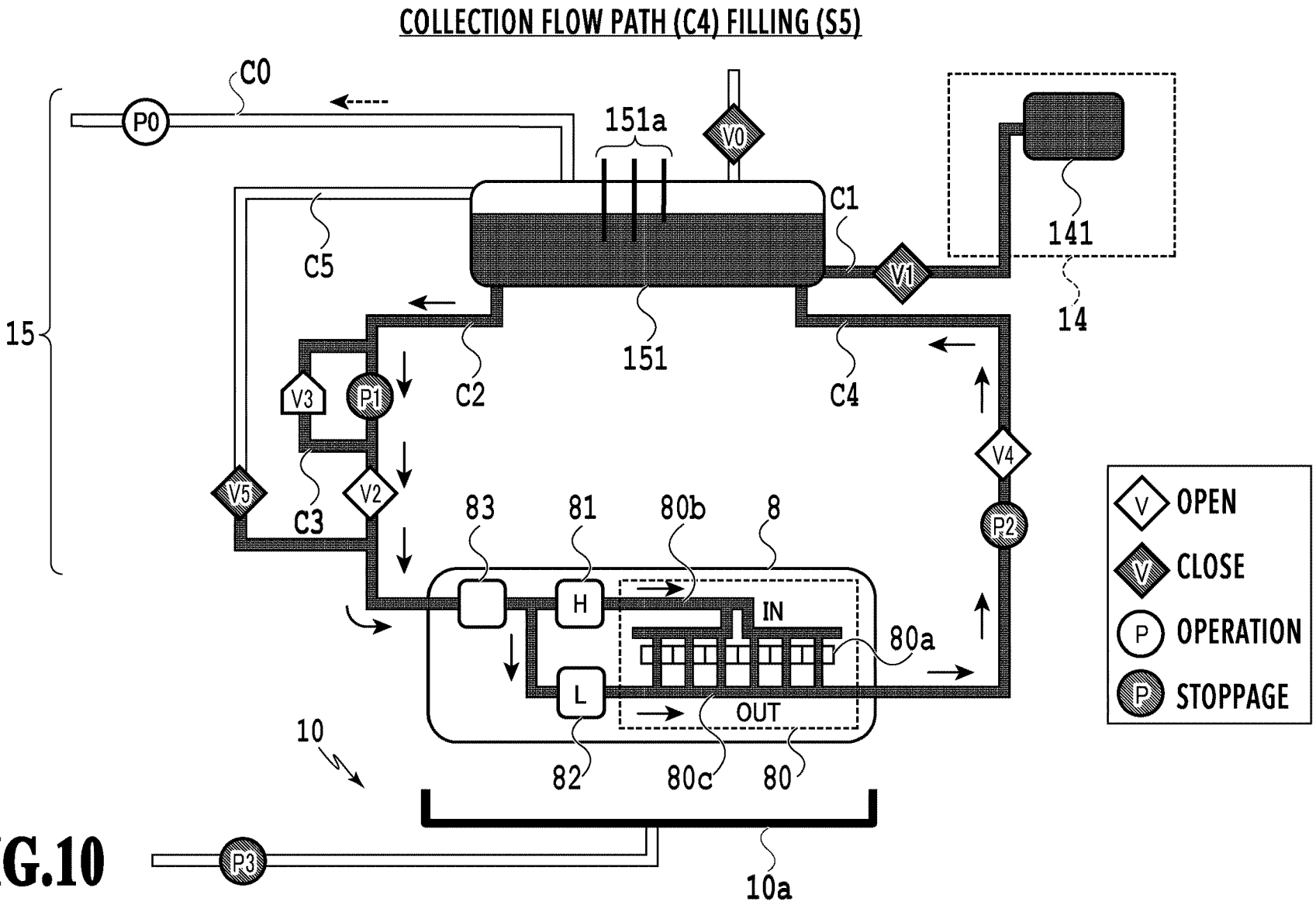
FIG. 10 illustrates a state in which a collection flow path is filled with ink.

FIG. 10 illustrates the state of the ink circulation system when the collection flow path C4 is filled with ink. After the printing head 8 is filled with ink, the collection valve V4 is opened and the atmosphere opening valve V0 is closed during which the depressurization pump P0 of the sub tank 151 is driven. While the collection valve V4 being opened and the atmosphere opening valve V0 being closed, the ink supply control unit 209 drives the depressurization pump P0 of the sub tank 151. When the depressurization pump P0 is driven, a negative pressure is generated in the sub tank 151 to thereby allow ink to flow from the printing head 8 to the collection flow path C4. After the collection flow path C4 is filled with ink, the ink supply control unit 209 stops the depressurization pump P0.

As described above, the sub tank 151, the printing head 8, and the flow path are filled with ink to thereby provide the ink ejection operation by the printing head 8 (i.e., a printing operation). In order to provide a printing operation, the ink supply control unit 209 closes the tank supply valve V1 and the head exchange valve V5 and opens the atmosphere opening valve V0, the supply valve V2, the relief valve V3, and the collection valve V4 to drive the supply pump P1 and the collection pump P2. This can consequently provide, while circulating ink again to the sub tank 151 via the printing head 8 from the sub tank 151, the discharge of ink through the printing head 8 to thereby performing a printing operation on a printing medium.

Next, the following section will describe an ink filling sequence to allow the ink circulation system to be filled with ink and the amount of ink stored in the sub tank 151 in the respective steps of this sequence. The following description will be made by way of an example of the ink filling sequence to the ink circulation system in the initial state in which no ink is supplied (i.e., so-called initial filling operation).

Figure 11:
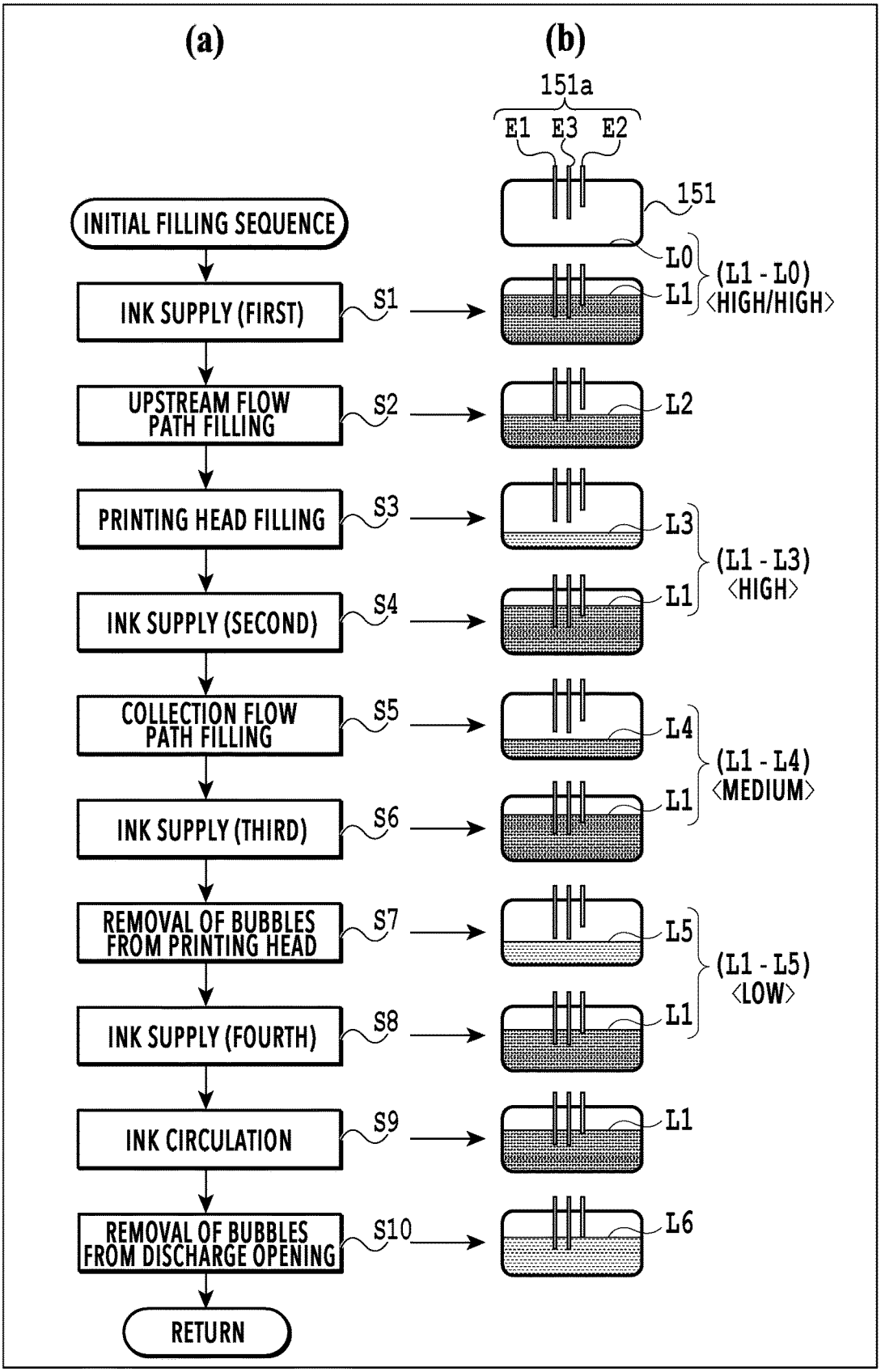
FIG. 11 illustrates a flowchart for initial filling sequence and illustrates an amounts of ink stored in the sub tank in the first embodiment.

A part (a) in FIG. 11 is a flowchart illustrating the ink initial filling sequence. A part (b) in FIG. 11 illustrates the amounts of ink stored in the sub tank 151 in the respective steps shown in the part (a) in FIG. 11. In the flowchart of the part (a) in FIG. 11, the character "S" added to each step number means "step".

The ink circulation system in the initial state is configured so that no ink is supplied as shown in FIG. 5 and no ink is stored in the sub tank 151. The part (b) in FIG. 11 illustrates this state by "L0". In S1, the ink circulation system in this initial state is subjected to the first ink supply operation. In this first ink supply operation, ink is supplied from the main tank 141 to the sub tank 151 to allow the sub tank 151 to be filled with a predetermined amount of ink. Specifically, ink is supplied until the second pin E2 of the liquid surface detection unit 151*a* is in a conductive state. Thereafter, ink is further supplied until the end of a predetermined supply duration time. This consequently allows the sub tank 151 to receive ink in an amount equal to or higher than the amount of ink required for the subsequent ink filing operation for the upstream flow path and the subsequent ink filing operation for the printing head 8. The amount of ink stored in the sub tank 151 by this supply is shown as "L1" in the part (b) in FIG. 11.

The supply duration time changes depending on the conditions under which ink is supplied from the main tank 141 to the sub tank 151 (liquid supply conditions). The supply duration time and ink supply conditions will be described in detail later. The respective components of the ink supply system during this first ink supply operation operate in the manner as described in FIG. 7 and thus will not be further described.

Next, in S2, ink in the sub tank 151 is sent to the allow the upstream flow path to be filled with ink (S2). This causes the amount of ink stored in the sub tank 151 to decrease as shown by "L2" of the part (b) in FIG. 11. The respective components of the ink supply system operate in order to allow the upstream flow path to be filled with ink in the manner as described in FIG. 8.

Next, in S3, ink in the upstream flow path is further allowed to flow to the downstream side to thereby allow the printing head 8 to be filled with ink. This filling operation causes the amount of ink stored in the sub tank 151 to decrease as shown by "L3" of the part (b) in FIG. 11. As a result, ink is separated from the first pin E1 of the liquid surface detection unit 151*a* and the first pin E1 is in a nonconductive state. The respective components of the ink supply system operate in order to perform the ink filing operation for the printing head 8 in the manner as described in FIG. 9.

Next, in S4, the sub tank 151 is subjected to the second ink supply operation. This second ink supply operation is performed as in the first ink supply operation. Specifically, as shown in FIG. 7, the atmosphere opening valve V0, the supply valve V2, the head exchange valve V5, and the collection valve V4 are closed and the tank supply valve V1 is opened to drive the depressurization pump P0 while the supply pump P1 and the collection pump P2 being stopped. This causes ink to be supplied from the main tank 141 to the sub tank 151. This second ink supply operation allows ink in the amount shown in L1 of the part (b) in FIG. 11 to be stored in the sub tank 151.

Next, in S5, the collection flow path C4 is filled with ink via the printing head 8, thereby allowing the entire ink supply system to be filled with ink. Then, the amount of ink stored in the sub tank 151 decreases as shown by "L4" of the part (b) in FIG. 11. This causes ink to be separated from the first electrode E1 and the first electrode E1 is in a nonconductive state. The respective components of the ink supply system operate in order to perform the ink filing operation for the collection flow path C4 in the manner as described in FIG. 10.

Next, in S6, the third ink supply operation is performed to send ink from the main tank 141 to the sub tank 151. This third ink supply operation is performed in the manner as in the first and second ink supply operations. This causes ink to be stored in the sub tank 151 in the amount shown by "L1" of the part (b) in FIG. 11.

Thereafter, in S7, in order to remove bubbles existing in the printing head 8, the cap unit 10 is driven to perform a suction recovery processing to suck ink from the printing head 8 in a forced manner. In this embodiment, a suction recovery processing called a choke suction is performed in this suction recovery processing. The choke suction is performed in the manner as described below. First, the supply valve V2, the head exchange valve V5, and the collection valve V4 are closed to drive the depressurization pump P3 while the ejection port face of the printing head 8*a* being covered by the cap member 10*a* to thereby increase the negative pressure in the cap member 10*a* (or to cause a decline of the absolute pressure). Thereafter, when the negative pressure in the cap member 10*a* increases to a predetermined value, the supply valve V2 is opened to drive the supply pump P1. This causes bubbles existing in the flow path (e.g., the IN flow path 80*b*, the OUT flow path 80*c*) formed in the printing head 8 to be sucked together with ink in a forced manner and the sucked matter is exhausted to the cap member 10*a*. This choke suction causes the amount of ink stored in the sub tank 151 to decrease as shown by "L5" of the part (b) in FIG. 11.

Next, in S8, the fourth ink supply operation is performed to send ink from the main tank 141 to the sub tank 151. This fourth ink supply operation is performed in the manner as in the first to third ink supply operations. This consequently causes ink to be stored in the sub tank 151 in the amount shown by "L1" of the part (b) in FIG. 11.

Next, in S9, ink is circulated between the sub tank 151 and the printing head 8 to send bubbles remaining in the entire ink flow path to the sub tank 151 to thereby remove bubbles in the ink flow path. In this operation, the amount of ink stored in the sub tank 151 is maintained at L1.

Thereafter, in S10, the printing head 8 is subjected to a suction wiping operation to remove bubbles remaining in the ejection port of the printing head 8. This suction wiping operation is an operation to suck bubbles from the ejection port formed in the ejection port face while wiping the ejection port face. This suction wiping operation causes the amount of ink stored in the sub tank 151 to slightly decrease as shown by "L6" of the part (b) in FIG. 11.

As described above, the amount of ink stored in the sub tank 151 changes as shown in the part (b) in FIG. 11 depending on the respective steps of the initial filling sequence. As in the initial filling operation, the amount of ink supplied from the main tank 141 to the sub tank 151 is determined based on the amount of ink stored in the sub tank 151 immediately before the ink supply operation.

In this embodiment, the operation to supply ink from the main tank 141 to the sub tank 151 is performed four times. Then, the amounts of ink stored in the sub tank 151 immediately before the respective ink supply operations are L0, L3, L4, and L5 having a magnitude correlation of L5>L4>L3>L0.

The amount of ink to be supplied from the main tank 141 to the sub tank 151 is caused to change depending on L0, L3, L4, and L5. For example, in the first ink supply operation performed in the initial state, ink in an amount of (L1−L0) is supplied. This is the maximum ink supply amount (liquid supply amount) in this embodiment. In the second ink supply operation performed after the printing head 8 is filled with ink, ink in an amount of (L1−L3) is supplied. This is the second-largest ink supply amount. In the third ink supply operation performed after the collection flow path C4 is filled with ink, ink in an amount of (L1−L4) is supplied. This is the third-largest ink supply amount. In the fourth ink supply operation performed after bubbles are removed from the flow path in the printing head 8, ink in an amount of (L1−L5) is supplied. This is the smallest ink supply amount.

It has been known that, when ink is supplied from the main tank 141 to the sub tank 151 as described above, bubbles in ink in the main tank 141 enter the sub tank 151 with ink. The bubbles entering the sub tank 151 are foamed in the vicinity of liquid surface and are expanded due to the depressurization in the sub tank 151. This causes the foamed ink to have a liquid surface height relatively higher than that of not-foamed ink. The difference therebetween increases with an increase of the time used to supply ink to the sub tank 151. This state is shown in FIGS. 12A and 12B.

Figure 12A:
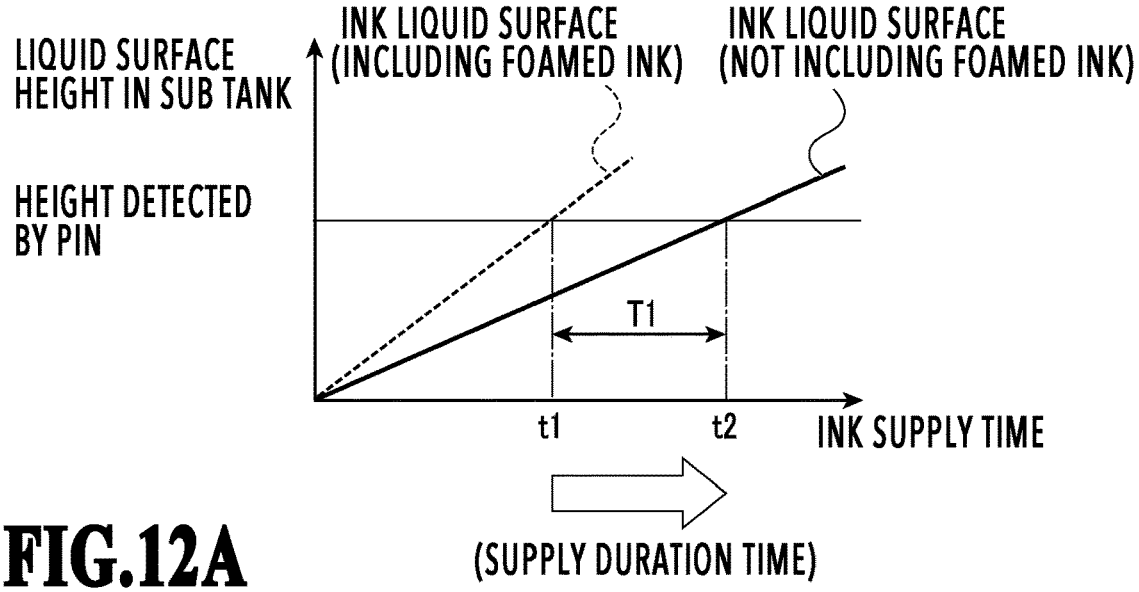
FIGS. 12A and 12B illustrate the relation between the time during which ink is supplied to the sub tank and a liquid surface height.
Figure 12B:
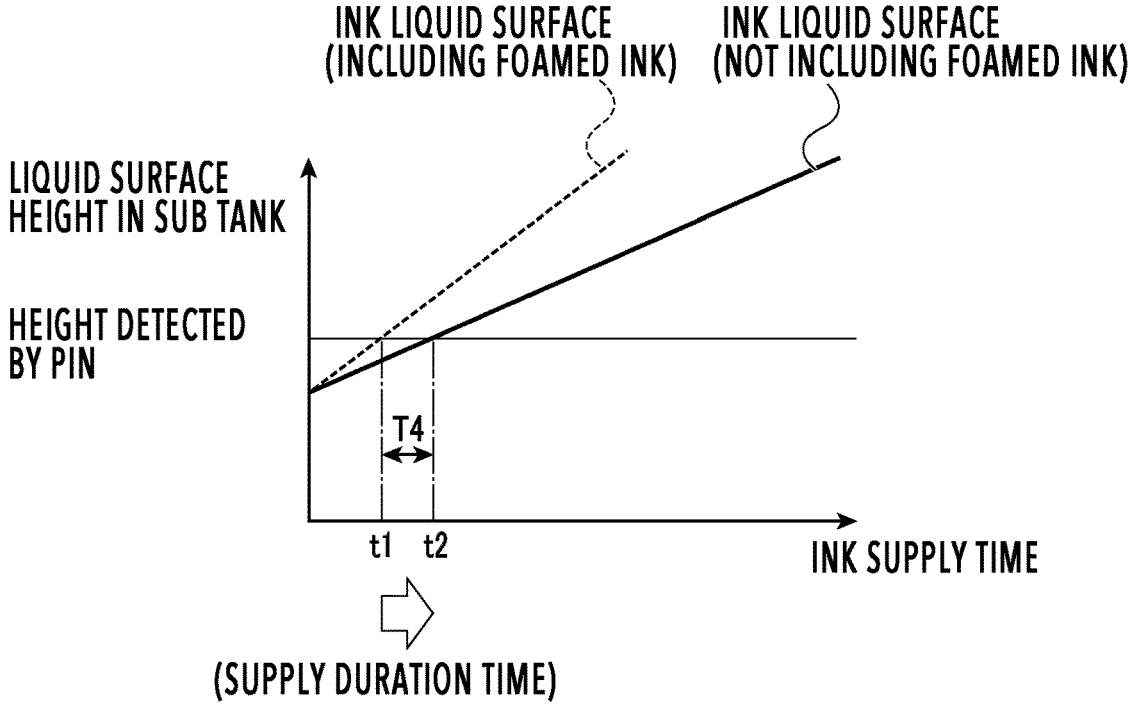

FIGS. 12A and 12B illustrate the relation between the time used to supply ink from the main tank 141 to the sub tank 151 (liquid supply time) and the height of the liquid surface in the sub tank 141. FIG. 12A illustrates a case where the first ink supply operation is performed in the initial filling sequence. FIG. 12B illustrates a case where the fourth ink supply operation is performed in the initial filling operation. In FIGS. 12A and 12B, the broken line illustrates a change in the liquid surface of foamed ink and the solid lines show a change of the liquid surface of not-foamed ink.

As shown in FIGS. 12A and 12B, when the time during which ink is supplied from the main tank 141 to the sub tank 151 reaches "t1", then the height of the liquid surface of foamed ink reaches, as shown by the illustrated broken lines, a height detected by the pin of the liquid surface detection unit 151*a* (i.e., the second pin E2 in this case). When the ink supply operation is stopped at this ink supply time t1 and the foaming disappears, then the ink liquid surface has a height lower than the height of the second pin E2, thus causing an actual ink amount to be lower than an amount of ink to be originally supplied. Specifically, the actual ink amount is lower than the amount of ink when the liquid surface of not-foamed ink is detected by the pin.

To prevent this, the ink supply operation is not stopped when the liquid surface is detected by the liquid surface detection unit 151*a* and is continued until the ink supply time reaches "t2". This consequently can supply ink in such a manner that the liquid surface of ink after the foaming disappears has a height equal to or higher than the height of the pin. Specifically, such an ink amount can be assured that is equal to or higher than the amount of ink when the liquid surface of not-foamed ink is detected by the pin.

In order to avoid the influence by bubbles, another approach may be considered to perform the ink supply operation after bubbles disappear. However, some ink characteristics may require a long time until bubbles generated in the sub tank 151 disappear. Thus, it is not efficient to wait for bubbles to disappear in an actual ink supply sequence prior to the start of the ink supply operation.

Thus, if an ink supply method is used for which bubbles may occur in the sub tank 151, such a control is effectively used to continuously supply ink even after the liquid surface is detected by the liquid surface detection unit 151*a*. However, in order to supply an appropriate amount of ink into the sub tank 151, an appropriate ink supply operation time (or supply duration time) performed after the liquid surface detection must be set in consideration of the amount of bubbles generated in the sub tank 151*a*. In the present invention, the amount of bubbles means a volume occupied by the bubbles.

The amount of bubbles generated in the sub tank 151 varies depending on the time to supply ink from the main tank 141 to the sub tank 151. Specifically, a long ink supply time causes an increase of ink supplied from the sub tank to the main tank 141. An increase of the ink supply amount causes an increase of the amount of bubbles entering the sub tank 151.

For example, among the four ink supply operations performed in the above-described initial filling sequence, the first ink supply operation requires the highest ink supply amount. Thus, the maximum amount of bubbles is generated in the sub tank 151 in the first ink supply operation. On the other hand, the smallest amount of ink is supplied to the sub tank 151 in the fourth ink supply operation. Thus, the smallest amount of bubbles is generated in the sub tank 151 in the fourth ink supply operation.

As described above, there is a correlation between the amount of bubbles generated in the sub tank 151 and the amount of ink supplied from the main tank 141 to the sub tank 151 (i.e., the time to supply ink from the main tank 141 to the sub tank 151 (ink supply time)). Thus, a control is provided to set, depending on the time to supply ink to the sub tank 151, the ink supply operation time (supply duration time) performed after the liquid surface is detected by the liquid surface detection unit 151*a*. Specifically, such a control is provided to increase the supply duration time in accordance with the increase of the time to supply ink to the sub tank 151.

For example, the first ink supply operation shown in FIG. 12A requires the longest ink supply time and thus the supply duration time (t2−t1) is set as the longest time T1. On the other hand, the fourth ink supply operation shown in FIG. 12B requires the shortest ink supply time and thus the supply duration time (t2−t1) is set as the shortest time T4.

As a result, the sub tank 151 can receive, in any ink supply operation, ink in the same amount as that obtained when the liquid surface of not-foamed ink reaches the second pin E2. This supply duration time is controlled by allowing the print controller 202 to control the ink supply control unit 209.

FIG. 13 illustrates an example of the supply duration times set by the printing apparatus 1 of this embodiment and an example of the supply duration time set by the conventional printing apparatus.

The four ink supply operations performed in the initial filling sequence are performed to supply different amounts of ink, respectively. In the table shown in FIG. 13, the first ink supply amount is represented as (high/high), the second ink supply amount is represented as (high), the third ink supply amount is represented as (medium), and the fourth ink supply amount is represented as (low).

In this embodiment, when the ink supply amount is (high/high) and (high), then the supply duration time is set as 10 sec to provide the maximum ink supply amount after the liquid surface is detected by the second pin E2 of the liquid surface detection unit 151*a*. When the ink supply amount is (medium), then the supply duration time is set as 7 sec to set the ink supply amount after the liquid surface is detected by the second pin E2 of the liquid surface detection unit 151*a* that is lower than those obtained when the ink supply amount is (high/high) and (high). When the ink supply amount is (low), the supply duration time is set as 4 sec to further decrease the ink supply amount after the liquid surface is detected by the second pin E2 of the liquid surface detection unit 151*a*.

On the other hand, in the case of the conventional printing apparatus as shown in Patent Literature (Japanese Patent Laid-Open No. 2010-208151), a fixed supply duration time (4 sec) is always set regardless of the magnitude of the amount of ink supplied from the main tank to the sub tank. Thus, when the ink supply amount is (low) as in the fourth ink supply operation of this embodiment, another possibility is caused where an appropriate amount of ink is supplied to the sub tank. However, an insufficient amount of ink may be supplied when an increased amount of ink is supplied from the main tank to the sub tank and an increased amount of bubbles is generated in the sub tank 1.

According to this embodiment, the supply duration time is increased or decreased in accordance with an increase or decreased of the mount of ink supplied to the sub tank 151. Thus, an appropriate amount of ink can be supplied to the sub tank 151 without an excess or deficiency. Thus, the printing apparatus 1 can include an ink circulation system always maintained in an appropriate ink supply state, thus providing a favorable printing operation.

Second Embodiment

Next, the following section will describe the second embodiment of the present invention.

In the above first embodiment, the supply duration time was controlled in consideration of the influence by the amount of bubbles changing depending on the time to supply ink from the main tank 141 to the sub tank 151 (ink supply amount). On the other hand, the second embodiment controls the supply duration time depending on the ratio of the amount of bubbles relative to the amount of ink in the main tank. The second embodiment also uses the configurations of FIG. 1 to FIG. 3.

In this embodiment, a different amount of ink is sent to the tank body having the same size and shape to thereby configure a main tank having a different size that can be used in a diversified manner as required. The main tank having such a configuration causes, due to the manufacturing reason, a fixed amount of bubbles entering the tank body regardless of the size. Thus, a different amount of ink supplied to the interior of the tank body causes the ratio between the amount of bubbles in the main tank 141 and the ink amount (a bubble/ink ratio) to be different depending on the size of the main tank 141.

An increase of the bubble/ink ratio causes, when a fixed amount of ink is supplied from the main tank 141 to the sub tank 151, an increase of the amount of bubbles entering the sub tank 151. Thus, even when a fixed amount of ink is supplied from the main tank 141 to the sub tank 151, a difference in the size of the main tank 141 causes a difference in the amount of bubbles entering the sub tank 151, thus causing a difference in the height of the liquid surface. Specifically, a difference in the main tank 141 to be used causes a difference in the amount of ink used until the liquid surface is detected by the liquid surface detection unit 151*a*.

In order to cope with this, according to this embodiment, the supply duration time depending on the size of the main tank 141 is set in advance to perform, based on the size of the attached main tank 141, an operation to supply ink after the liquid surface is detected. According to this, the sub tank 151 can receive ink in an amount equal to or higher than the amount when the liquid surface of not-foamed ink is detected by the liquid surface detection unit 151*a*.

Figure 14A:
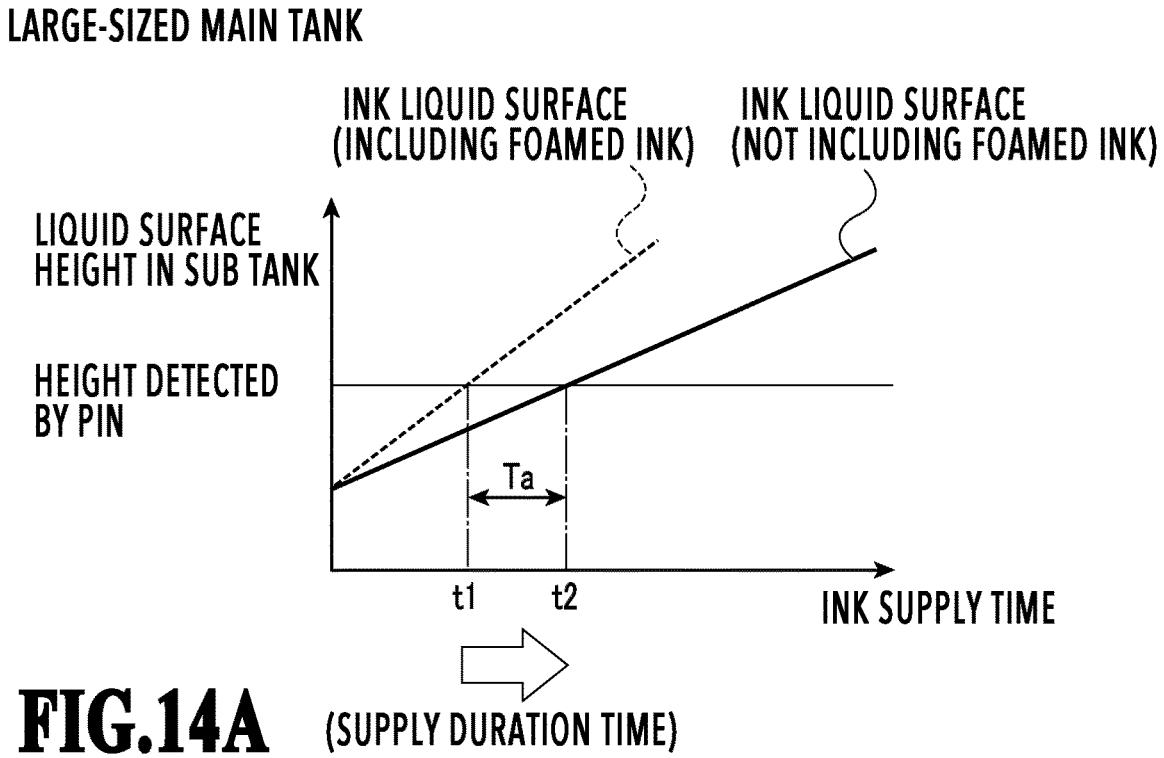
FIGS. 14A and 14B illustrate the relation between the time during which ink is supplied to the sub tank in the second embodiment and the liquid surface height.
Figure 14B:
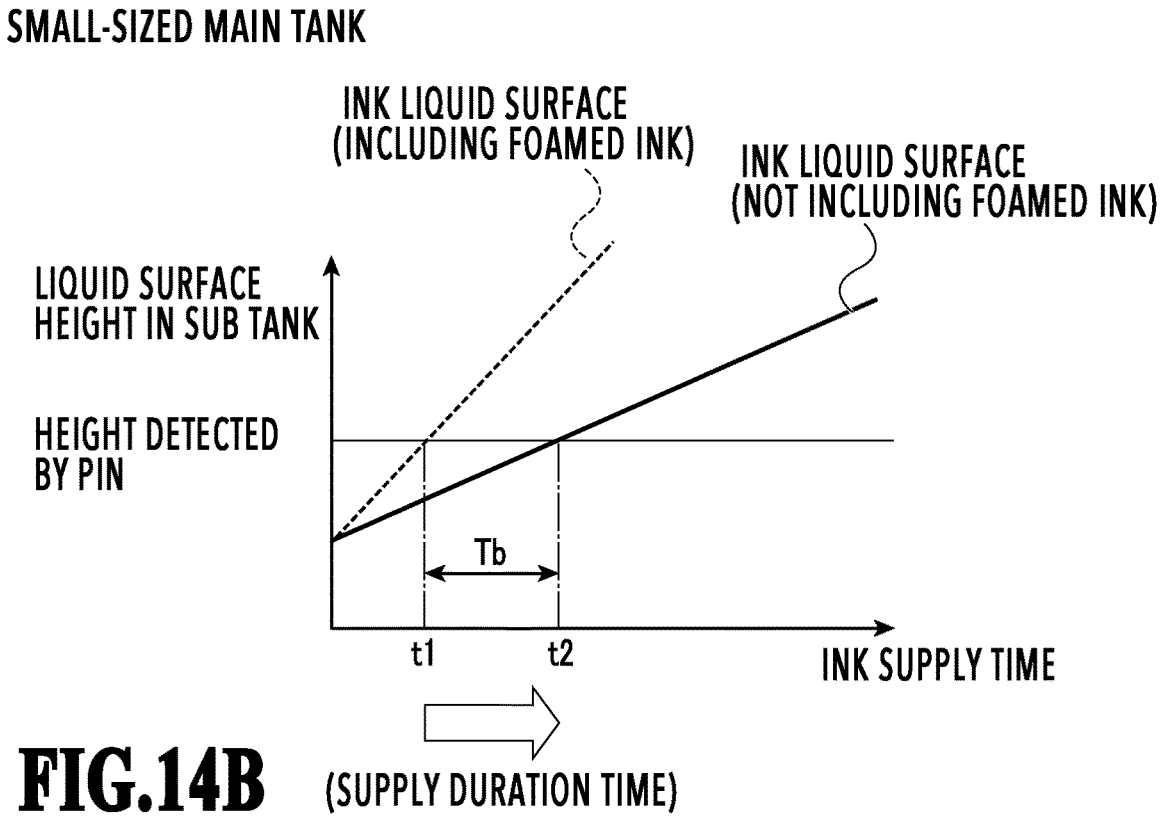

FIGS. 14A and 14B illustrate the relation between the time used to supply ink from the main tank 141 to the sub tank 151 and the height of the liquid surface in the sub tank. FIG. 14A shows a case where a large-sized main tank is used while FIG. 14B shows a case where a small-sized main tank is used, respectively. The broken lines shown in FIGS. 14A and 14B show a change of the liquid surfaces of foamed ink while the solid lines show a change of the liquid surfaces of not-foamed ink, respectively.

The large-sized main tank 141 has a low bubble/ink ratio and thus a small amount of bubbles enters the sub tank 151 and an amount of ink is detected by the liquid surface detection unit 151*a* with a reduced error. Thus, as shown in FIG. 14A, a relatively-short supply duration time Ta (t2−t1) is set.

On the other hand, the small-sized main tank 141 has a high bubble/ink ratio and thus a higher amount of bubbles enters the sub tank 151. An amount of ink is detected by the liquid surface detection unit 151*a* with increased errors. Thus, when the small-sized main tank 141 is used, the relatively-long supply duration time Tb (t2−t1) is set as shown in FIG. 14A.

FIG. 15 illustrates the relation between the bubble/ink ratios corresponding to the respective sizes of the main tank 141 and the supply-stopped time. FIG. 15 shows a case where the main tanks 141 having a large size, a medium size, and a small size are used. As shown, the bubble/ink ratio decreases with an increase of the size of the main tank 141. Specifically, the bubble/ink ratio is smaller in an order of the small size, the medium size, and the large size.

Thus, the main tank 141 having the large size has the supply duration time set to 4 sec. The main tank 141 having the medium size has the supply duration time set to 7 sec. The main tank 141 having the small size has the supply duration time set to 10 sec because the maximum amount of bubbles enter the sub tank 151.

On the other hand, in the case of the conventional printing apparatus, a fixed supply duration time (4 sec) is used regardless of the bubble/ink ratio of the main tank. Thus, when the large-sized main tank having a low bubble/ink ratio is used, an appropriate amount of ink also may be supplied to the sub tank. However, the sub tank may receive an insufficient amount of ink if the main tank has a higher bubble/ink ratio and the sub tank 1 includes an increased amount of bubbles.

According to this embodiment, the supply duration time may be increased or decreased depending on the magnitude of the size of the main tank 141. Thus, an appropriate amount of ink can be supplied to the sub tank 151 regardless of the size of the main tank 141.

OTHER EMBODIMENTS

In the above embodiment, an example was shown where the supply duration time (ink supply amount) was controlled based on the bubble/ink ratio used as ink supply conditions in order to supply ink from the main tank 141 to the sub tank 151 or the bubble/ink ratio in the main tank. However, the present invention is not limited to this. The supply duration time also can be controlled based on ink supply conditions other than the ink supply time and the bubble/ink ratio.

For example, the supply duration time also can be controlled based on a negative pressure generated in the sub tank or the type of ink supplied to the sub tank. According to the present invention, the supply duration time is controlled based on one or a plurality of ink supply condition(s) having the correlation with the amount of bubbles generated in the sub tank. This can consequently supply an appropriate amount of ink to a storage unit such as the sub tank.

Another configuration also may be used where the supply duration time is controlled depending on the type of ink. Specifically, a control may be provided to increase the supply duration time of easily-foamed ink to be longer than the supply duration time of not-easily-foamed ink. Also according to the above embodiment, the printing apparatus constituting the ink circulation system has been described as an example. However, the present invention is not limited to this. Specifically, the present invention can be applied to all printing apparatuses using an ink supply method to supply ink from the main tank to the sub tank.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189673 filed Oct. 5, 2018, which is hereby incorporated by reference wherein in its entirety.

What is claimed is:

1. A liquid supply apparatus, comprising:

a main tank for storing liquid;

a sub tank for storing liquid supplied from the main tank;

a liquid supply unit configured to perform an operation to supply liquid from the main tank to the sub tank;

a liquid surface detection unit configured to detect a liquid surface of the liquid stored in the sub tank; and a control unit configured to control the liquid supply unit to execute a first liquid supply operation to control the liquid supply unit to supply liquid to the sub tank until the liquid surface is detected by the liquid surface detection unit and a second liquid supply operation to supply liquid to the sub tank after the liquid surface is detected by the liquid surface detection unit, wherein:

the control unit controls, based on at least one of a liquid supply amount and a liquid supply time in the first liquid supply operation, the time during which the second liquid supply operation is executed.

2. The liquid supply apparatus according to claim 1, wherein:

the control unit is configured, in a case where the liquid supply time is a first time, to cause the execution of the second liquid supply operation for a first duration time and, in a case where the liquid supply time is a second time longer than the first time, to cause the execution of the second liquid supply operation for a second duration time longer than the first duration time.

3. The liquid supply apparatus according to claim 1, wherein:

the control unit causes, in a case where the liquid supply amount is a first amount, the second liquid supply operation to be executed for the first duration time and causes, in a case where the liquid supply amount is a second amount higher than the first amount, the second supply operation to be executed for a second duration time longer than the first duration time.

4. The liquid supply apparatus according to claim 1, wherein:

the liquid supply apparatus includes:

a supply flow path for supplying the liquid from the sub tank to the liquid ejection head for discharging liquid; and a collection flow path for collecting the liquid from the liquid ejection head to the sub tank, and the sub tank, the supply flow path, the liquid ejection head, and the collection flow path constitute a circulation path in which the liquid is circulated.

5. The liquid supply apparatus according to claim 1, wherein:

the liquid surface detection unit includes an electrode provided in the sub tank at a predetermined height, and the electrode has a conductive state when touching the liquid.

6. The liquid supply apparatus according to claim 1, wherein:

the liquid supply unit is composed of:

a flow path extending from the main tank to the sub tank; and a valve providing the switching between the communication and blocking of the flow path.

7. The liquid supply apparatus according to claim 6, wherein:

the liquid supply unit further includes a negative pressure generation unit configured to generate a negative pressure in the sub tank.

8. A liquid supply method, comprising:

a main tank for storing liquid;

a sub tank for storing liquid supplied from the main tank: and a liquid surface detection unit configured to detect a liquid surface of the liquid stored in the sub tank, wherein:

liquid is supplied from the main tank to the sub tank depending on the result detected by the liquid surface detection unit, the method includes:

a first supply step of supplying liquid to the sub tank until the liquid surface is detected by the liquid surface detection unit; and a second supply step of supplying liquid to the sub tank after the liquid surface is detected by the liquid surface detection unit, and the second supply step controls the time to supply liquid to the sub tank based on at least one of a liquid supply amount and a liquid supply time in the first liquid supply operation.

9. A liquid discharge apparatus, comprising:

a sub tank for storing liquid supplied from a main tank; and a liquid ejection head which ejects liquid supplied from the sub tank, wherein:

the liquid discharge apparatus includes:

a liquid supply unit configured to perform an operation to supply liquid from the main tank to the sub tank;

a liquid surface detection unit configured to detect a liquid surface of the liquid stored in the sub tank; and a control unit configured to control the liquid supply unit to execute a first liquid supply operation to control the liquid supply unit to supply liquid to the sub tank until the liquid surface is detected by the liquid surface detection unit and a second liquid supply operation to supply liquid to the sub tank after the liquid surface is detected by the liquid surface detection unit, and wherein the control unit controls, based on at least one of a liquid supply amount and a liquid supply time in the first liquid supply operation, the time during which the second liquid supply operation is executed.

10. The liquid discharge apparatus according to claim 9, wherein:

the liquid supply apparatus includes:

a supply flow path for supplying the liquid from the sub tank to the liquid ejection head; and a collection flow path for collecting the liquid from the liquid ejection head to the sub tank, and the sub tank, the supply flow path, the liquid ejection head, and the collection flow path constitute a circulation path in which the liquid is circulated.

* * * * *